US011358072B2

(12) United States Patent
Greenwood

(10) Patent No.: US 11,358,072 B2
(45) Date of Patent: Jun. 14, 2022

(54) REUSABLE TOY CAPSULE APPARATUS INCLUDING WATER PLAY METHODS

(71) Applicant: Hasbro, Inc., Pawtucket, RI (US)

(72) Inventor: Benjamin Scott Greenwood, Congleton (GB)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 17/348,450

(22) Filed: Jun. 15, 2021

(65) Prior Publication Data

US 2021/0387105 A1 Dec. 16, 2021

Related U.S. Application Data

(60) Provisional application No. 63/039,499, filed on Jun. 16, 2020.

(51) Int. Cl.
*A63H 33/18* (2006.01)
*A63H 23/12* (2006.01)

(52) U.S. Cl.
CPC ..... *A63H 33/18* (2013.01); *A63H 23/12* (2013.01)

(58) Field of Classification Search
CPC ..... A63H 33/18; A63H 23/10; A63H 23/12; A63H 37/00; A63H 37/08; A63H 39/08; A63F 2009/0084
USPC ..... 473/569, 577, 594; 446/153, 475
See application file for complete search history.

(56) References Cited

U.S. PATENT DOCUMENTS 4,212,460 A 7/1980 Kraft
4,886,273 A 12/1989 Unger
4,991,847 A * 2/1991 Rudell ..... A63F 9/00 273/138.1
5,240,450 A * 8/1993 Graham ..... A63H 33/30 434/11
5,254,379 A * 10/1993 Kotsiopoulos ..... B29C 65/08 102/501
5,538,456 A 7/1996 Liu et al.
5,688,567 A * 11/1997 Daulton ..... G09F 19/12 428/11

(Continued)

FOREIGN PATENT DOCUMENTS

CN 201543247 U 8/2010
KR 20000018398 U 3/1999

OTHER PUBLICATIONS

PCT/US21/37441 ISR Transmittal, Written Opinion, and ISA Search 1-769 PCT papers dated Sep. 23, 2021.

*Primary Examiner* — Joseph B Baldori
(74) *Attorney, Agent, or Firm* — Perry Hoffman

(57) ABSTRACT

An amusement device in the general form of a reusable water capsule that explodes with the affect of toys commonly referred to as water-balloons and the like. User may choice between a reusable exploding water capsule to be thrown at a target and a device for shooting a directional stream of water similar to a "squirt gun". A variety of various shaped flexible components each of which including a first wall with a first wall external surface and a first wall internal surface, and a second wall with a second wall external surface and a second wall internal surface for interconnection. This toy may be used as packaging, within the capsule, for additional items. The combination of unique design with the typically chosen softness of the material used to make the capsule means much of the kinetic energy in a throw is dissipated in a water burst.

16 Claims, 16 Drawing Sheets

(56) References Cited

U.S. PATENT DOCUMENTS

| | | | | |
|---|---|---|---|---|
| 5,848,946 | A | 12/1998 | Stillinger | |
| 5,975,983 | A | 11/1999 | Panec | |
| 6,527,616 | B1 | 3/2003 | Li | |
| 6,533,637 | B1 | 3/2003 | Liao | |
| 6,585,555 | B2 | 7/2003 | Wong et al. | |
| 7,481,727 | B2 | 1/2009 | Chia | |
| 9,315,282 | B2 | 4/2016 | Malone | |
| 2011/0003655 | A1 | 1/2011 | Chernick et al. | |
| 2013/0118640 | A1* | 5/2013 | Saggio ..... | A63H 27/10 141/313 |

* cited by examiner

REUSABLE TOY CAPSULE APPARATUS INCLUDING WATER PLAY METHODS

PRIORITY CROSS-REFERENCE TO RELATED APPLICATION

This application claims priority pursuant to 35 U.S.C. 119(e) or 120 from U.S. Provisional Application No. 63/039,499 filed Jun. 16, 2020 for inventions disclosed therein.

BACKGROUND OF THE INVENTION

1. Field of the Invention

The present invention relates to toys, and more particularly to mechanical toy apparatus including fillable water game toy structures concerning reusable toy water capsules, capsule toys, and the like considered to operate in accordance with a two-part refillable water balloon feature that bursts or explodes apart to in the fashion of a balloon burst effect.

2. Background of the Invention

There are many known toys and toy play sets which incorporate assemblies for water toys which may be categorized into single-use water-balloons, reusable splash toys and reusable water squirt toys. Currently, the water bomb market is divided between single use water balloons and reusable splash toys. The problem is children make one big mess throwing single use plastic water balloons and worse other reusable water bombs are just plain disappointing which cannot explode like balloons and fail as a real alternative to messy bursting balloons.

It is known to provide either single-use water-balloons, or reusable splash toys alternatively which may carry a sufficient body of water when thrown at an intended target to soak the target. However, single-use water-balloons such as those used in U.S. Pat. No. 9,315,282 to Malone for "System and Method for Filling Containers with Fluids" create substantial quantities of litter when they hit a target and break apart. This is a real issue in today's busy and environmentally conscious world. There have been some attempts to create reusable toy capsules that are intended to have an explosive splash, dousing a target when thrown. Some of these inventions break apart on impact and others release water through some kind of valve on impact.

China Utility Model CN 201543247 U of Aug. 11, 2010 to Myers, et al, for Game Device includes an upper part and a lower part which can be closed to form a hollow ball. The upper part and the lower part are a hemispherical upper part and a hemispherical lower part. The upper part and the lower part are provided with hemispherical cavities for accommodating water when in use. In order to increase the strength of the game device, reinforcing ribs are provided on the outer surfaces of the upper part and the lower part, respectively. Korea Utility Model Application KR 20000018398 U of Mar. 18, 1999 to Lee, et al., for Playing Ball, discloses dividing a ball into many divisions with perforated grooves formed on the ball's body with many segmented pieces connected vertically with perforated grooves that are formed uniformly on the body of an elastic ball, wherein the supporting pieces formed inside the segmented pieces come in contact with the outer surface.

Likewise U.S. Pat. No. 4,212,460 to Kraft for "Hollow Water-Filled Game Toy" relates to reusable capsules which break apart on impact yet requires dissimilar parts of hard plastic material for the mechanics of the device to work. The Kraft capsule has overlapping small joints limiting the design to a hard plastic. Consequently the safe use of the toy is compromised and can hurt on impact with a person. U.S. Pat. No. 5,975,983 to Panec for "Reusable Water-Containing Toy" concerns reusable capsules but employs mechanical valves to work by removing energy from an impact with a target to open the valves. As such the foregoing prior art limits the size of splash and consequently reduces desirability and prove to be disappointing in use. Further U.S. Pat. No. 5,848,946 to Stillinger for "Filled, deformable bladder amusement device with infinitely changeable pliability and tactility characteristics" issued Dec. 15, 1998; U.S. Pat. No. 6,527,616 to Li for "Throwing toy for producing splash effect" issued Mar. 4, 2003; U.S. Pat. No. 6,533,637 to Liao for "Impact expanding projectile device and its associated method of manufacture" issued Mar. 18, 2003; U.S. Pat. No. 6,585,555 to Wong, et al. for "Temperature sensitive color changing water toy" issued Jul. 1, 2003; U.S. Pat. No. 7,481,727 to Chia for "Water-release toy" issued Jan. 27, 2009; US Patent Application No. 20110003655 A1 to Chernick, et al. for "Segmented High-Bounce Toy Water Ball" published Jan. 6, 2011 disclose similar prior art water ball concepts.

Significantly, known toys do not include water toy apparatus and methods with reusable toy water capsule, or capsule toy which may be considered to operate as a refillable water balloon with two-part suction feature in a fashion that is simple with unique fillable water game toy capsule structures that are easy for anyone to fill and throw and exciting for a user. Moreover known single-use water balloons create litter, and known reusable splash water toy capsules intended to have an explosive affect often disappoint in use. It would be desirable to provide a reusable toy water capsule solution to the problem of explosive, reusable water bombs. Whereas the novel reusable toy water capsule explodes apart to produce an effect equal to a balloon burst.

SUMMARY OF THE INVENTION

The embodiments of the inventions disclosed herein facilitate a sealed hollow capsule assembled from two complimentary interlocking sealing components. The interlocking seal of the two components is identical. The components can be joined repeatably using their interlocking structure creating a seal when the capsule is filled with water. Various embodiments of the invention are disclosed as including reusable toy capsule apparatus with a pair, plurality of multiple flexible components having first and second walls with respective external and internal wall surfaces. In a described embodiment, each of two capsule walls are integrally formed together with the first wall external surface having a curved surface in the shape of a half sphere, and the second wall external surface having a curved surface in the shape of a quarter sphere with said second wall integrally formed with said first wall together as a curved surface in the shape of a three-quarter sphere, defining a fluid-holding interior, and a fluid seal or flanges formed with the flexible components. The coupling flange allows for being brought into apposition with the portion of the first wall internal surface.

An embodiment the invention is in the general form of a water toy capsule with an intended form of exploding water balloons and the like. Another embodiment the invention is in the form of a directional hand powered water squirt to compete with squirt gun toys. Further embodiments may include a number of components supplied having two or more to be assembled. Supplying a number of components where any one component will fit with any other improves play giving a similar experience as having a number of water balloon-type structures.

Briefly summarized, several disclosed embodiments of the invention provide a plurality of various shaped flexible components each of which including a first wall with a first wall external surface and a first wall internal surface, and a second wall with a second wall external surface and a second wall internal surface. The second wall is disposing with structure integrally together with the first wall, and a portion of each second wall external surface includes a fluid seal which may be provided as a coupling flange formed together for being brought into apposition with a portion of the first wall internal surface forming a fluid seal between the plurality of various shaped flexible components, thus defining a fluid-holding interior where fluid is received between the first wall and the second wall. The fluid-holding interior between the plurality of flexible components first and the second wall external surfaces are brought into apposition in use to allow for a partial vacuum sufficient for a lower relative internal pressure inside the fluid-holding interior for creating a suction force that moves fluid into the fluid-holding interior within the plurality of flexible components. The fluid seal with the plurality of flexible components which may be provided as a coupling flange formed with a portion of each second wall external surface is brought into apposition with a portion of each first wall internal surface of the plurality of flexible components. The reusable toy capsule fluid in the fluid-holding interior may be maintained structurally through the mechanical structural integrity of the flexible components, which may be assisted due to hydrostatic pressure of the fluid pushing against the walls to generate surface tension at the fluid-holding interior within the plurality of flexible components.

BRIEF DESCRIPTION OF THE DRAWINGS

For the purpose of facilitating an understanding of the inventions, the accompanying drawings and description illustrate described embodiments thereof, from which the inventions, structure, construction and operation, and many related advantages may be readily understood and appreciated.

DETAILED DESCRIPTION OF THE EMBODIMENTS

As described herein, fillable water toy concerning reusable toy water capsules, capsule toys, and the like considered to operate in accordance with a two-part refillable water balloon feature that bursts or explodes apart to in the fashion of a balloon burst effect, and explode apart to produce an affect similar to a balloon burst when thrown at a target. The combination of unique design with the typically chosen softness of the material used to make the capsule means much of the kinetic energy in a throw is dissipated in a water burst.

Figure 1:
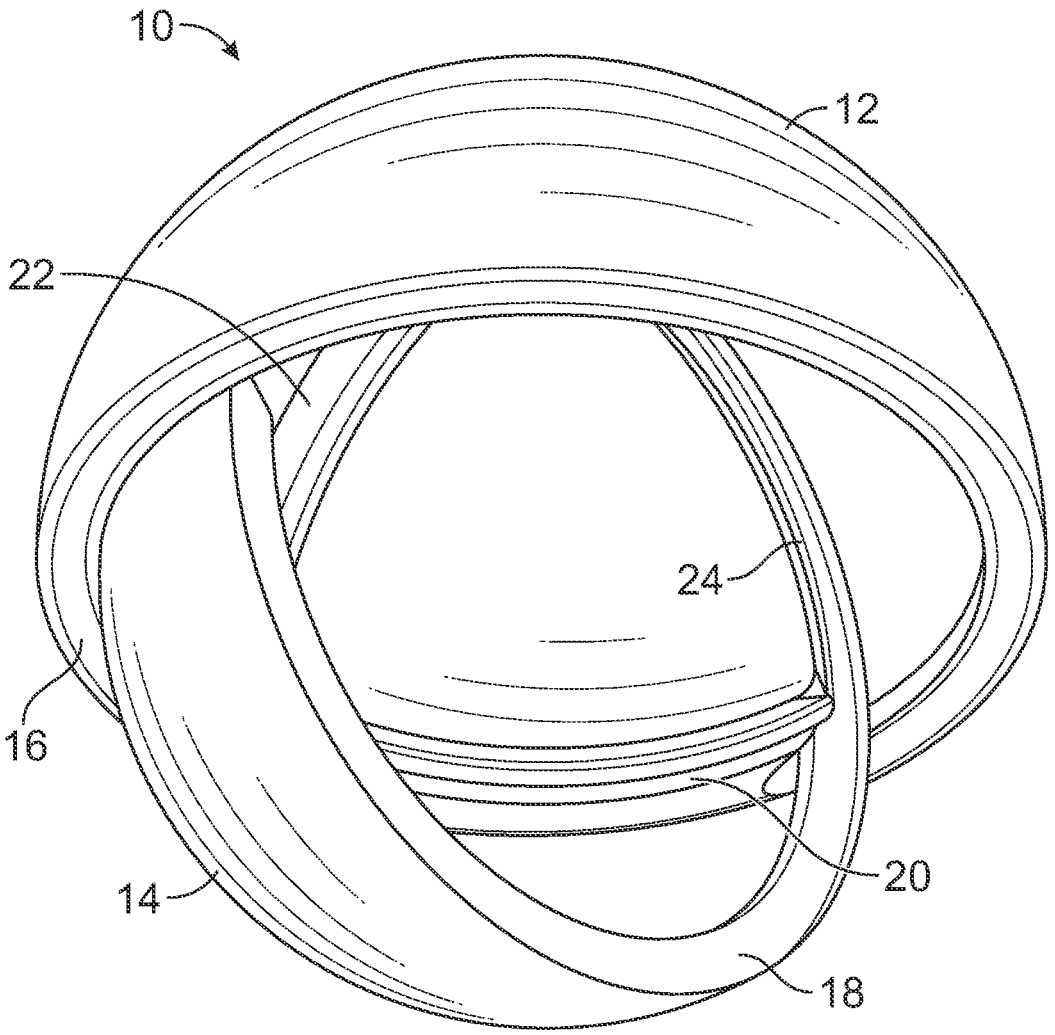
FIG. 1 is a first perspective view of a complimentary sealing capsule component to be assembled in accordance with the invention.
Figure 2:
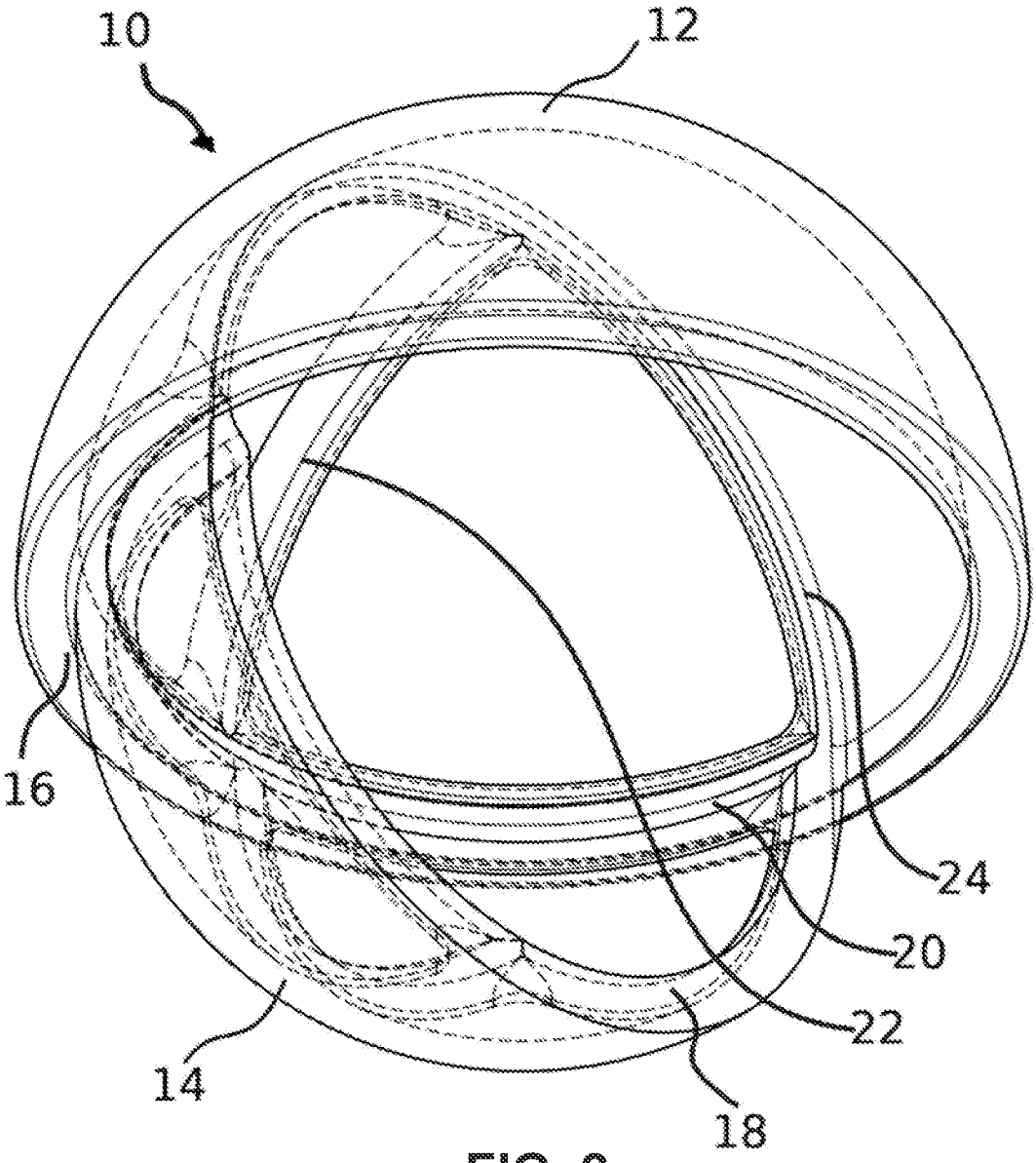
FIG. 2 is a second perspective view with hidden lines of a complimentary sealing capsule component to be assembled in accordance with the invention.

With reference to FIGS. 1 and 2 is a side perspective view of a single capsule component of a pair of complimentary flexible components 10, in the shape of a three-quarter sphere where the flexible component has a first wall 12 having a first wall external surface and a first wall internal surface. A second wall 14 has a second wall external surface that serves as a primary coupling flange, with the second wall 14 integrally formed together with the first wall 12 defining a fluid-holding interior for receiving fluid between the first wall 12 and said second wall 14 internal sealing capsule surfaces. Each of the first and second walls include external and internal surface thereof. The coupling flange of the second wall 14 is integrally provided at external surface of the second wall, where the second wall 14 extends from the first wall 12 and facilitates a primary fluid seal formed as between the pair of flexible components when brought together as discussed below FIGS. 3 through 8 where complimentary sealing capsule flexible components pairs of two identical interlocking sealing components 10 in accordance with the invention. Herein a portion of each second wall external surface is brought into apposition with a portion of each first wall internal surface of the pair of flexible components.

Primary sealing edge 16 and an internal, secondary sealing edge 18 may be provided additionally with complementary thicknesses for maintaining the seal and may include a sharp right-angled structure or otherwise crafted the component shapes so as to fit complementary components. FIG. 2 is a side perspective view with hidden lines of the capsule component to be assembled with an optional supporting rib 20 further seal, an optional supporting rib from seal, 24, and further optional internal supporting rib 22 to capsule surface. The ribs reduce the amount material in the walls of the capsule components.

Figure 3:
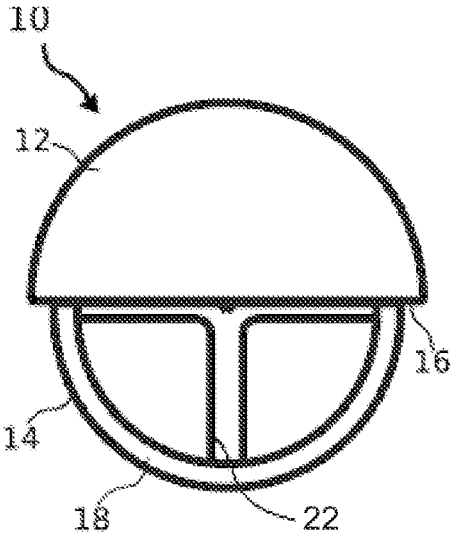
FIGS. 3 through 8 are views of the complimentary sealing capsule flexible components pairs of two identical interlocking sealing components in accordance with the invention.
Figure 4:
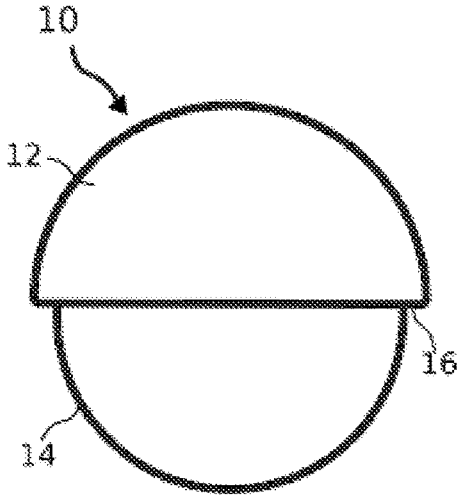
Figure 5:
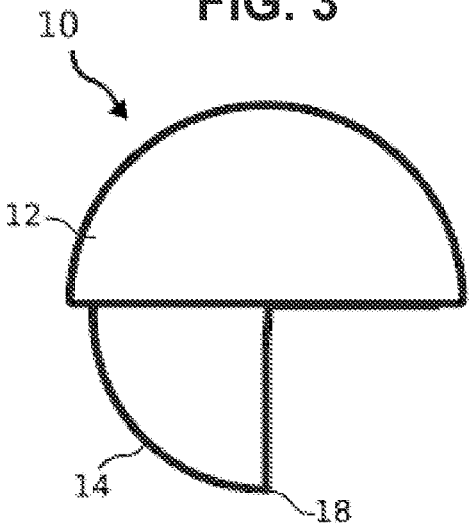
Figure 6:
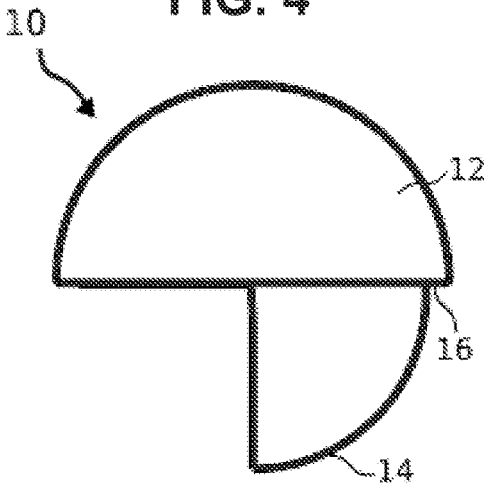
Figure 7:
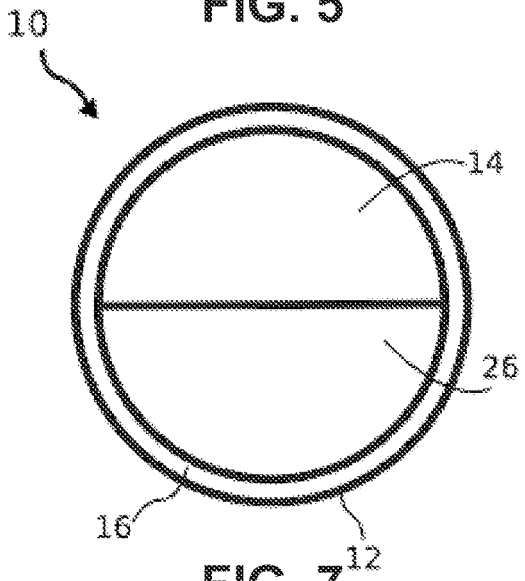
Figure 8:
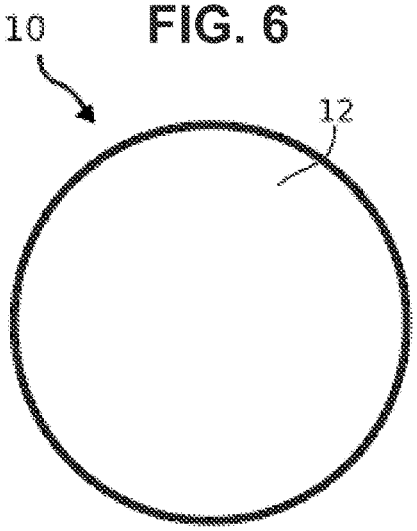
Figure 9:
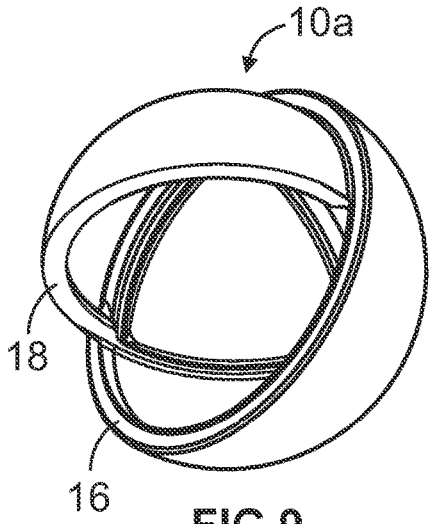
FIG. 9 through 12 are views of the component pairs of two identical interlocking sealing components to be assembled with the complimentary sealing capsule flexible components pairs in accordance with the invention.
Figure 10:
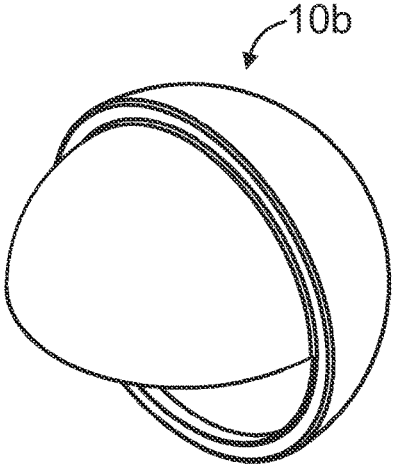
Figure 11:
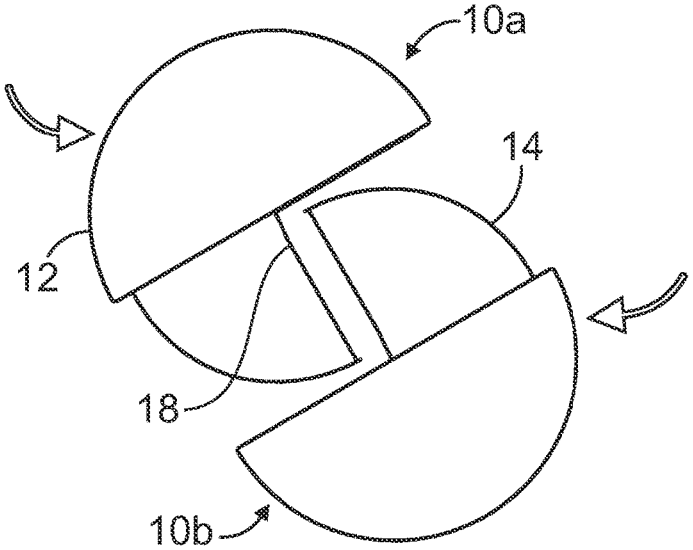
Figure 12:
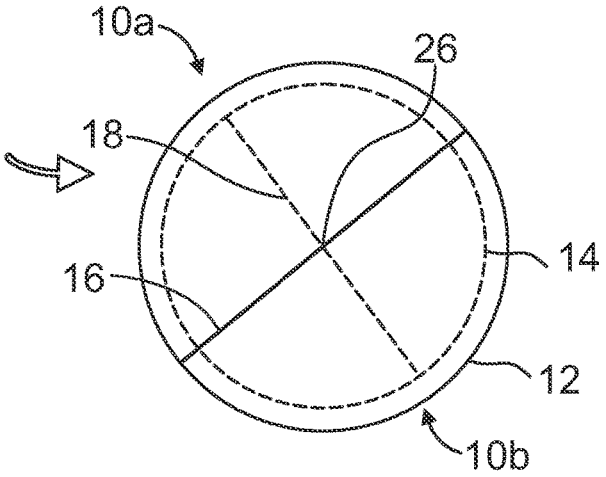

FIGS. 3 through 8 illustrate the complimentary sealing of flexible components pairs of two identical interlocking sealing components 10, where FIG. 3 is a front view of a capsule component 10 defining a fluid-holding interior for receiving fluid of capsule 10. FIG. 4 is a rear view of the capsule 10 and FIG. 5 is a side left view of the capsule 10 complimentary components, and FIGS. 5 and 6 are respective right and left side elevational views of complimentary flexible components 10. FIGS. 7 and 8 are plan top and bottom views of capsule components 10. FIG. 9 is a side perspective view of a capsule component to be assembled in accordance with complimentary capsule component 10*a*, and FIG. 10 is a side perspective view of a capsule component 10*b* to be assembled in accordance with the complimentary capsule component embodiments. The present described embodiment provides capsule 10 made of two identical components where the shape of the capsule is topologically equivalent to the surface of a sphere. As illustrated with FIGS. 11 and 12, the fillable water game toy capsule components 10 provide easy assembly. While the present described embodiment is in the form of a sphere shaped capsule, any two complimentary sealing capsules 10 *a* and 10 *b* may be held and aligned, mirroring one another, and pushed together to create a completed sealed capsule of FIG. 12. As discussed, two sealing surfaces or coupling flanges of the second wall 14, edges 16 and 18 of two components together form a sealed capsule.

Figure 13:
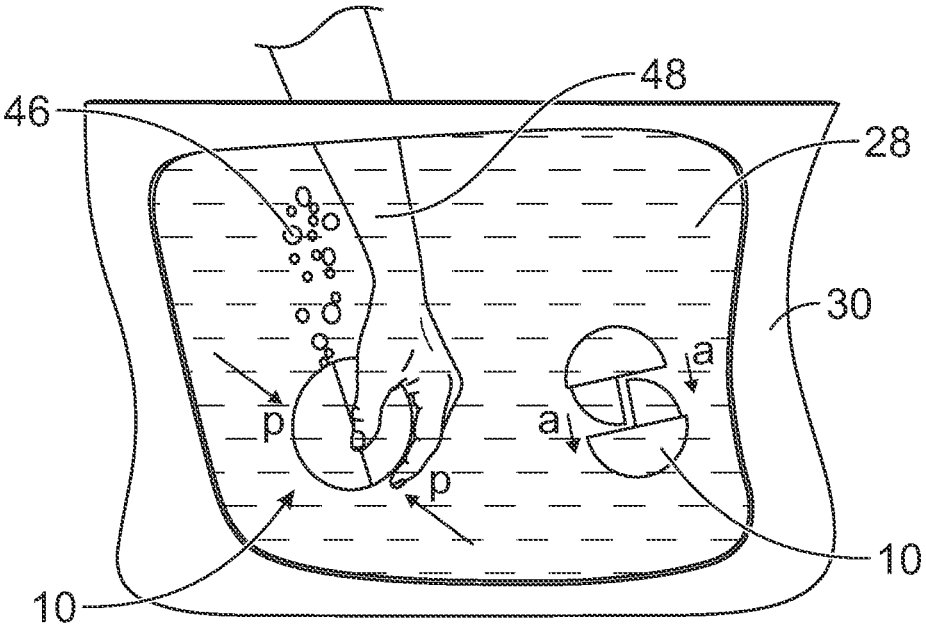
FIG. 13 is a side perspective view of the assembled capsule being submerged in water to fill the capsule with water.
Figure 14:
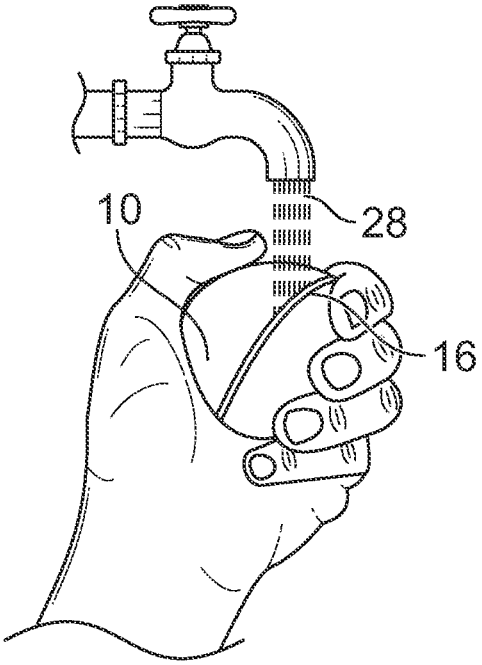
FIG. 14 is a top perspective view of an assembled capsule being submerged under water flowing from a tap to fill it with water.

FIG. 13 is a side perspective view of an assembled capsule being submerged in water to fill the capsule with water. The assembled capsule is being compressed with pressure "p" to remove air. A further capsule is shown with arrows "a" to indicate how the capsule is to be assembled. Liquid such as water 28 is shown within a water bucket 30, container or water proof fabric container 30. A user's hand 48/and capsule apparatus 10 are shown in a cutaway net bag 44 where air bubbles 46 are expelled. The fillable water game toy structures sealing mechanism with the use of soft rubber hold together a two-part suction coupling mechanism of the two quarter spheres acting similar to a vacuum with the air displaced partially by water inside. The identical components, interlink they have a seal/coupling which allow them to interlock, the sphere remains whole when empty. When submerged, squeezing may open the interlocking seal couplings with a gap with retraction of the shape which pulls the water in. After 3-4 of these squeezes under water, they are full, air is removed, the seal/coupling together, keeps the water inside. Water is trapped in the assembled capsule before lifting it out of the water. FIG. 14 is a side perspective view of an assembled capsule being submerged under water flowing from a tap to fill it with water. Here water held in the capsule passes between the internal surface complimentary adjacent surface and edges 16 and the two orifices 26 to escape entrapment. The capsule can be held under water and air squeezed out by pressing and squishing the completed capsule by hand; when the hand pressure is released water is sucked past the broken seal displacing air/pulling in water with suction force and retraction of shape back to sphere's shape with water sliding in, and hydrostatic pressure pushing out, maintaining water pushing against object walls or surface generating surface tension. Even when less than full the capsule seals work holding the complimentary components of the capsule together as intended.

Figure 15:
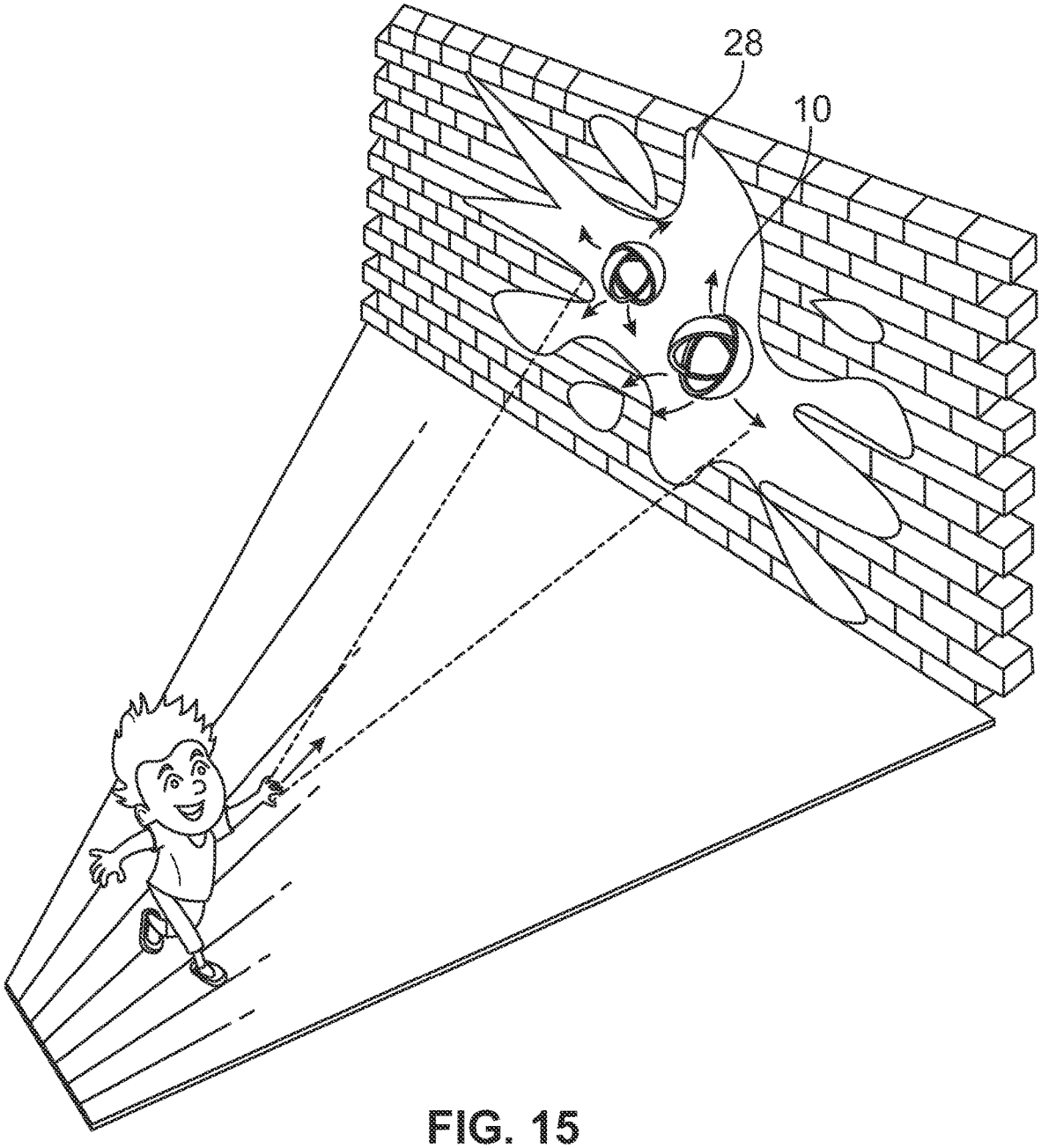
FIG. 15 is a side perspective view of an assembled capsule being thrown against a target, exploding and bursting in accordance with the invention.
Figure 16:
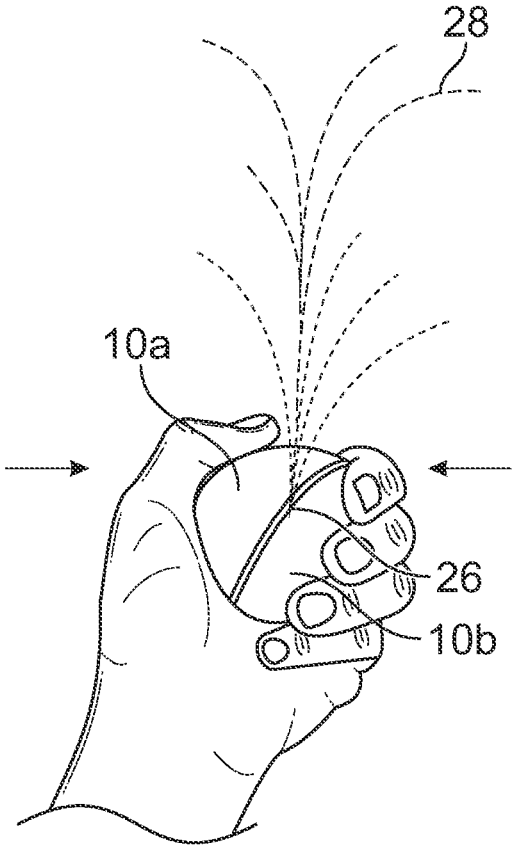
FIG. 16 is a top perspective view of an assembled capsule being squeezed to create a directional water squirt gun in accordance with the invention.

The user has a choice between throwing the capsule at a target FIG. 15 or squeezing the capsule and directing a water squirt at a target of FIG. 16. The capsule or water blaster may be thrown as a water toy capsule or squeezed to eject a squirt of water which can be used repeatedly through the use of a hollow capsule assembled from a number of complimentary interlocking sealing components. The components can be joined using their interlocking structure creating a seal when the capsule is filled with water. After a use and breaking apart the components can be collected and reassembled again to re-form a capsule. When thrown the filled capsule of FIG. 15 will explode with splash, like a water filled balloon. When using a water toy capsule 10 as a water squirt gun FIG. 16, one orifice needs to be placed in the palm of the hand to stop the potential for opening and the second orifice is aimed towards at a target. When squeezed water will squirt from the capsule apparatus 10 from unblocked orifice 26 producing a similar effect to squirt guns. They remain stable in flight, soon as the capsule impacts a relatively stationary surface the seal or coupling separates and causes the capsule to split into its components, causing the water to burst out. When the fillable water game toy structured capsule hits a target, the surface tension of its contained water explodes with the energy of a balloon burst.

As disclosed the present described embodiments provide a plurality of various shaped flexible components each of which including a first wall with a first wall external surface and a first wall internal surface, and a second wall with a second wall external surface and a second wall internal surface. The second wall is disposing with structure integrally together with the first wall, and a portion of each second wall external surface includes a fluid seal which may be provided as a coupling flange formed together for being brought into apposition with a portion of the first wall internal surface forming a fluid seal between the plurality of various shaped flexible components, thus defining a fluid-holding interior where fluid is received between the first wall and the second wall.

The fluid-holding interior between the plurality of flexible components first and the second wall external surfaces are brought into apposition in use to allow for a partial vacuum sufficient for a lower relative internal pressure inside the fluid-holding interior for creating a suction force that moves fluid into the fluid-holding interior within the plurality of flexible components. The fluid seal with the plurality of flexible components which may be provided as a coupling flange formed with a portion of each second wall external surface is brought into apposition with a portion of each first wall internal surface of the plurality of flexible components. The reusable toy capsule with fluid in the fluid-holding interior may be maintained structurally through the mechanical structural integrity of the flexible components, which may be assisted due to hydrostatic pressure of the fluid pushing against the walls to generate surface tension at the fluid-holding interior within the plurality of flexible components. The seal is sufficient to create a partial vacuum that holds the capsule together. The capsule 10 can be thrown or propelled from say a toy gun and it will only break apart on impact releasing the contained water. A soft construction means a substantive amount of the kinetic energy of a throw is released in a splash in a manner to rival throwing a filled water-balloon advantageously without the litter made by water-balloons that need to be collected, recycled or thrown away.

Filling is achieved through the suction force created relative to pressure differential for lower internal pressure for suction force drawing water into ball via partial vacuum relates to the partial vacuum being sufficient for a lower relative internal pressure inside the ball creating a suction force that moves water into the capsule. (Fill relative to pressure differential for lower internal pressure for suction force moving water into capsule) as sufficient for the said capsule to hold a fluid. The partial vacuum relates to the partial vacuum being sufficient for a lower relative internal pressure inside the capsule creating a suction force that moves water into the capsule. (Fill relative to pressure differential for lower internal pressure for suction force moving water into capsule.) Then, separately as to maintaining (holding fluid) after the capsule is filled, appears to be hydrostatic pressure of the water pushing out, i.e. pushing against the walls generates surface tension. Suction is the force that a partial vacuum exerts upon a solid, liquid, or a gas. Removing air from a space results in this pressure differential. Suction pressure is therefore limited by external air pressure. The pressure differential of the surrounding environment (water) pressure being relatively greater than the lower internal pressure where the air is removed, results in water in the higher pressure environment exerting a force relative to the lower internal pressure of the capsule. With the capsule submerged and compressed, air is expressed and water comes in because it seeks to fill a void not necessarily due to vacuum. Once recovery of the wall commences, it is believed the water may accelerate filling due to expansion of the walls and pulling in of the water (suction).

The toy capsule can be filled with water in a number of ways which include:

(1). To fill the toy capsule with water the interlocking sealing components are first joined to create a capsule. The capsule can then be compressed whilst under water to purge the contained air. This deforms the capsule and breaks the seal allowing water to enter the capsule. Then by releasing from compression the capsule returns to its original sealed shape;

(2). The capsule also can be filled by deforming the capsule and holding it under a running tap, e.g., FIG. 14; and (3). Further, the capsule can also be filled by assembling the components under water FIG. 13. The capsule flexible components first and the second wall external surfaces are brought into apposition providing a partial vacuum sufficient for a lower relative internal pressure inside the fluid-holding interior to create a suction force that moves fluid into the fluid-holding interior within the cavity formed by the flexible components.

Figure 17:
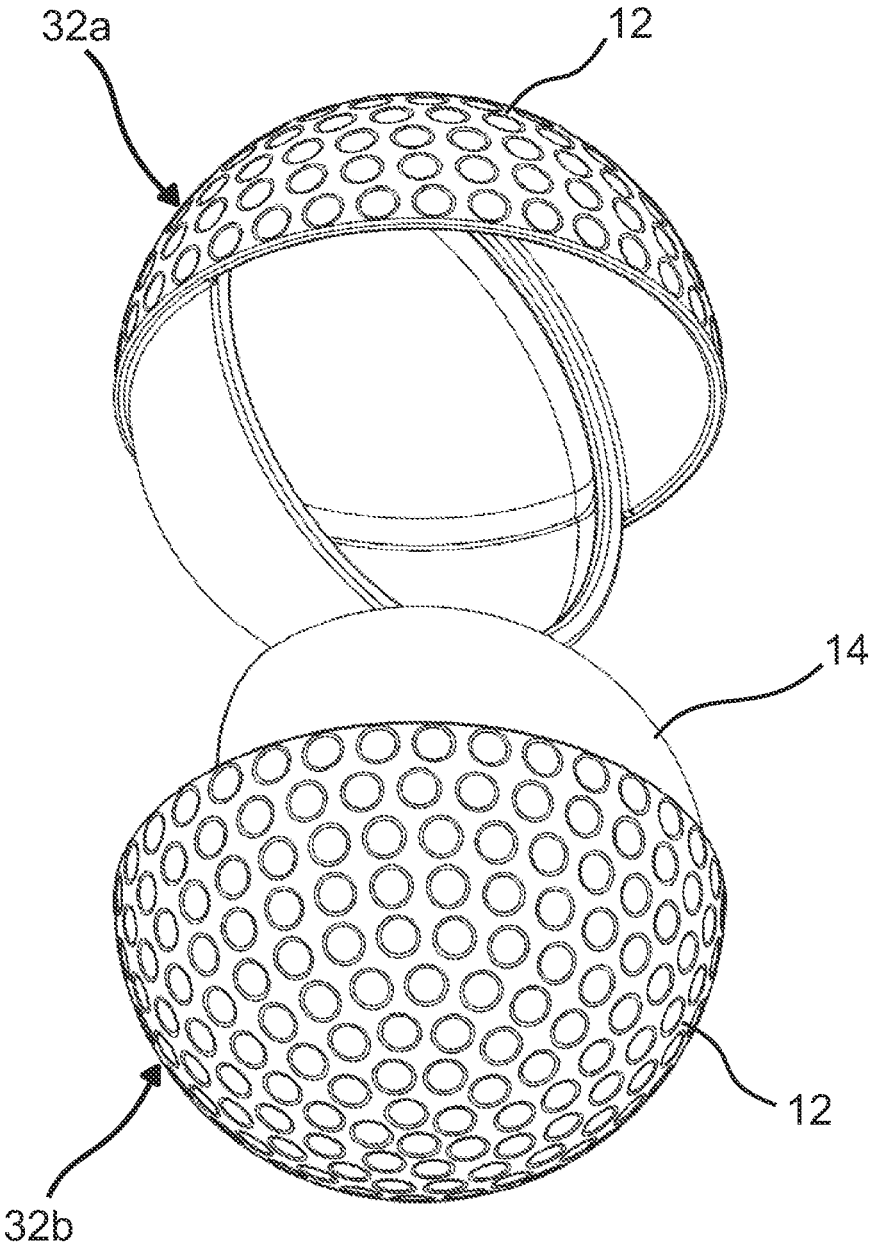
FIG. 17 illustrates an additional design option with exterior dimples on the external complimentary capsule surface as a ridged textured surface pattern.
Figure 18:
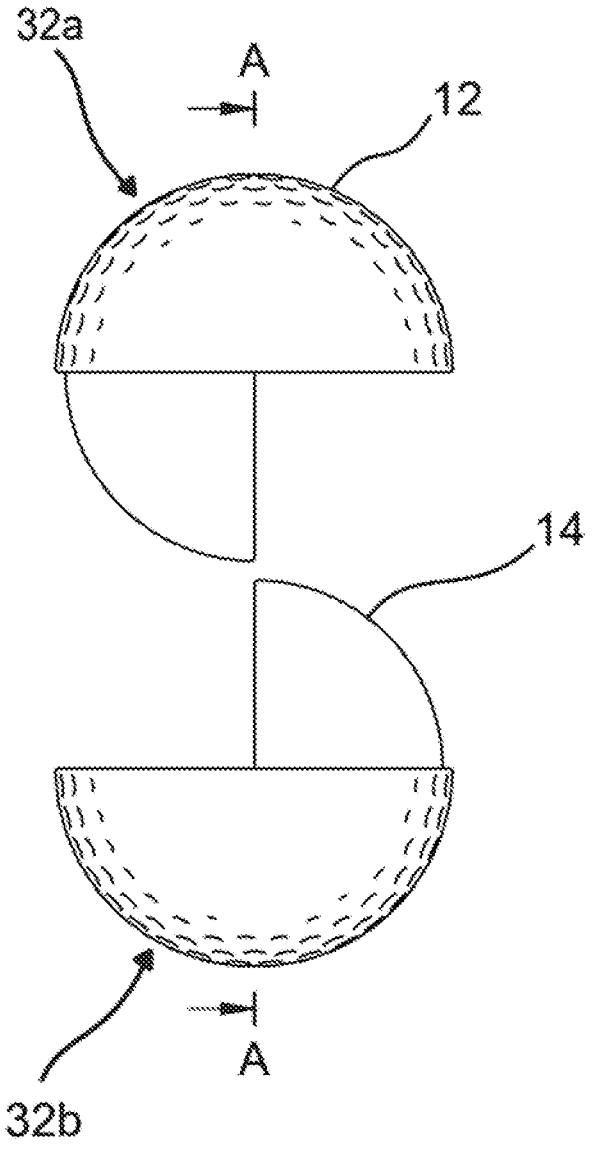
FIG. 18 Exterior view of capsule surface with a surface pattern with dimples. External complimentary capsule surface in accordance with the invention.
Figure 19:
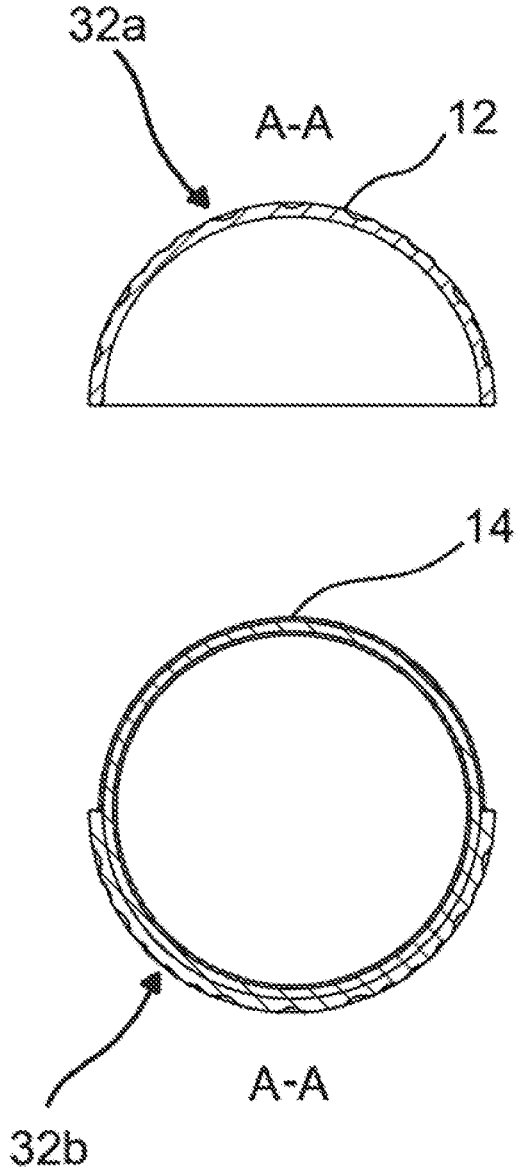
FIG. 19 Cross section of external and internal sealing surfaces with a surface pattern. External complimentary capsule surface in accordance with the invention.

FIG. 17 illustrates an additional design option with exterior dimples on the external complimentary capsule surface, 12. Internal sealing capsule surfaces, 14. Dimples on external capsule surface, 32*a*. Dimples on complimentary external capsule surface, 32*b*. Throughout this design option is a ridged textured surface pattern. FIGS. 18 and 19 are exterior and cross section of external and internal sealing surfaces with a surface pattern having dimples on external capsule surface 32*a*, and complimentary external capsule surface 32*b*.

Figure 20:
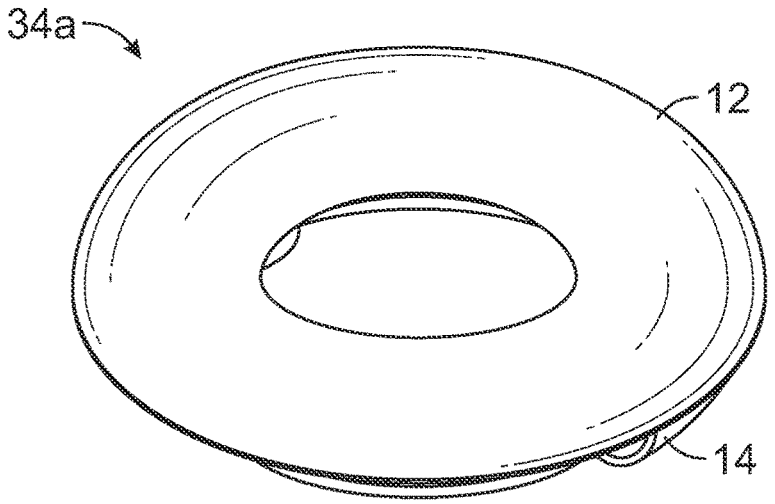
FIGS. 20, 21 and 22 illustrate additional design torus shaped capsule components, as an assembled torus shaped capsule in the form of a doughnut ring and the like in accordance with the invention.
Figure 21:
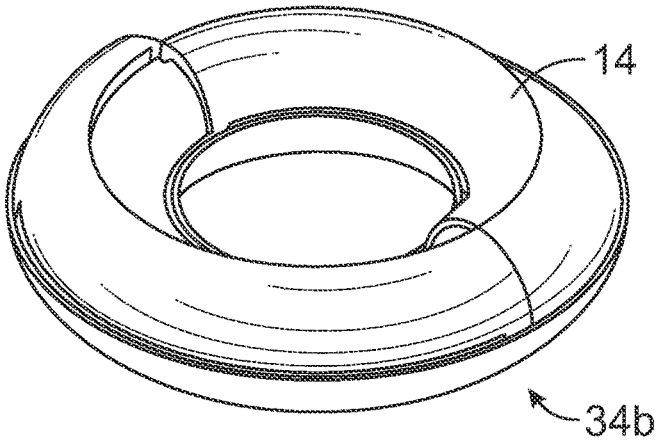
Figure 22:
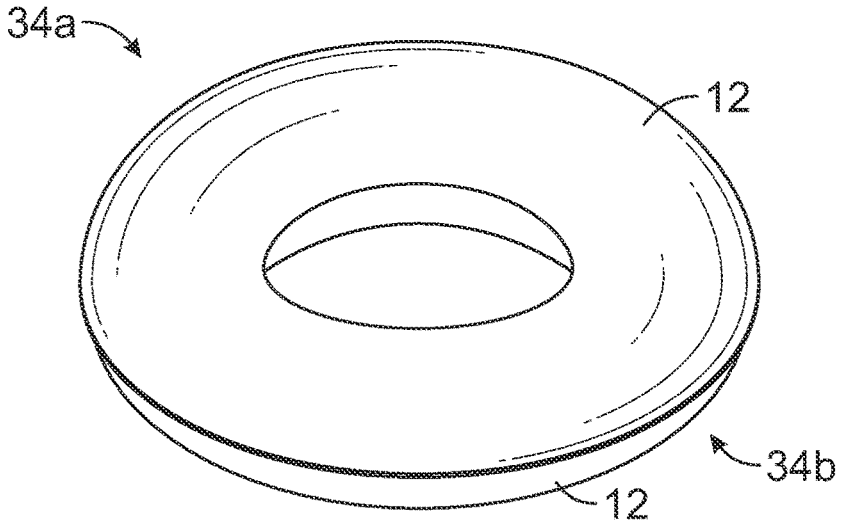

Turning to the embodiments of FIGS. 20 thorough 25 additional design shapes such as an oval prolate spheroid shaped capsule, rounded with and slightly elongated outline may be implemented. The embodiments are not limited to capsules whose shape is topologically equivalent of a sphere, and components may vary in number, size or shape. The shape of the capsule may be topologically equivalent to sphere or a torus. The external appearance may vary thus in shape as well as translucency, color or surface textures, yet the components will still mate to form a seal. For example a torus is possible. The capsule shapes and external design could be in the form of doughnuts, bagels, burgers to permit a "food fight." FIG. 20 illustrates additional design torus shaped capsule component in the form of a doughnut ring and the like. External complimentary capsule surface 12, and internal sealing capsule surfaces 14 with exterior section of ring 34*a*. FIG. 21 illustrates additional design shape of a torus shaped capsule component ring. Internal sealing capsule surfaces 14 and interior section of ring 34*b*, where FIG. 22 illustrates additional design shape of a torus shaped capsule component ring. External complimentary capsule surface 12. Internal sealing capsule surfaces, 14. Exterior section of ring, 34*a*. Interior section of ring, 34*b*. The torus made from two identical components can have four (4) orifices, each of which can be blocked, compressed and stomped on to squirt through the orifices. Moreover, each different embodiment of the described the spherical-shaped capsules may squirt water directionally when stomped on.

Figure 23:
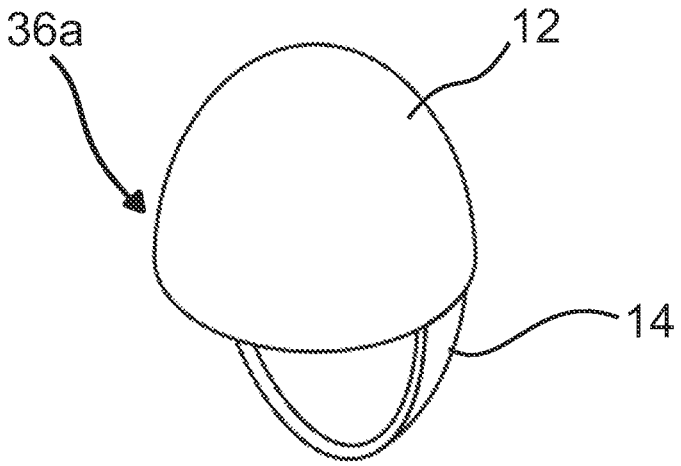
FIGS. 23, 24 and 25 illustrate additional design shape of an oval prolate spheroid shaped capsule components, rounded with and slightly elongated outline. An assembled oval prolate spheroid shaped capsule and the like in accordance with the invention.
Figure 24:
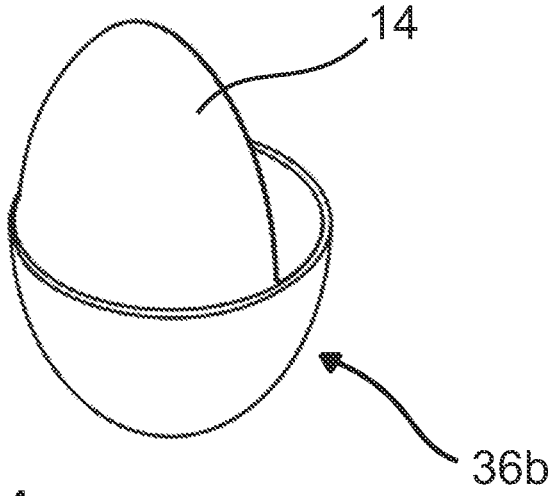
Figure 25:
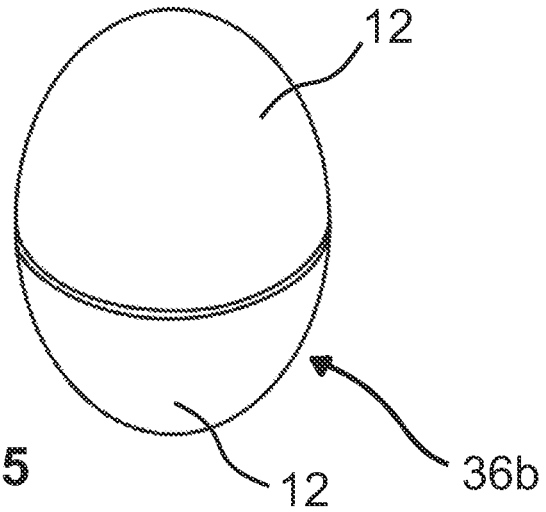

FIG. 23 illustrates additional design shape of an oval prolate spheroid shaped capsule, rounded with and slightly elongated outline. External complimentary capsule surface 12 with internal sealing capsule surfaces 14, and exterior section of oval 36*a*. In the present described embodiments where the components may vary in size and shape and not limited to spheres or to ovoid, cubic or spheroid-cylindrical shapes. The external appearance may vary in shape, color or surface textures, yet any two components will still mate with any other component which has an identical shaped seal. FIG. 24 illustrates additional design shape of an oval spheroid shaped capsule, rounded with and slightly elongated outline. External complimentary capsule surface 12 with internal sealing capsule surfaces 14, and exterior section of oval 36*b*. FIG. 25 illustrates additional design shape of an oval spheroid shaped capsule, rounded with and slightly elongated outline of external complimentary capsule surface 12 with complimentary exterior section of oval 36*a* and 36*b*.

Figure 26:
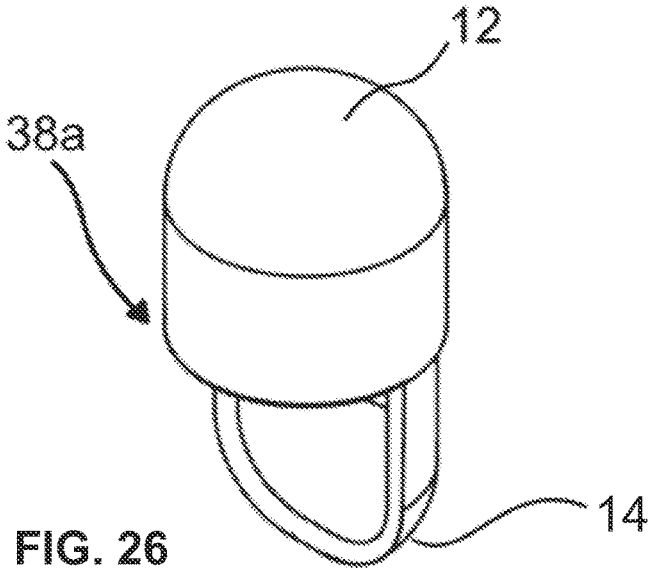
FIGS. 26, 27 and 28 illustrate additional design shape of a capsule, or sphero-cylinder and the like in accordance with the invention.
Figure 27:
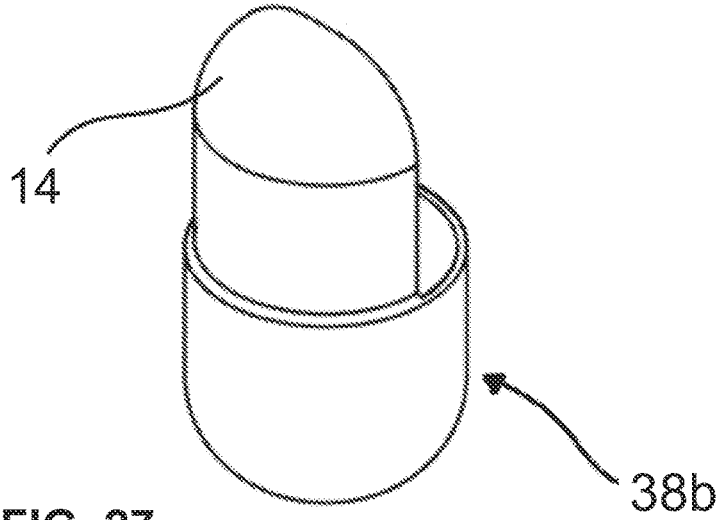
Figure 28:
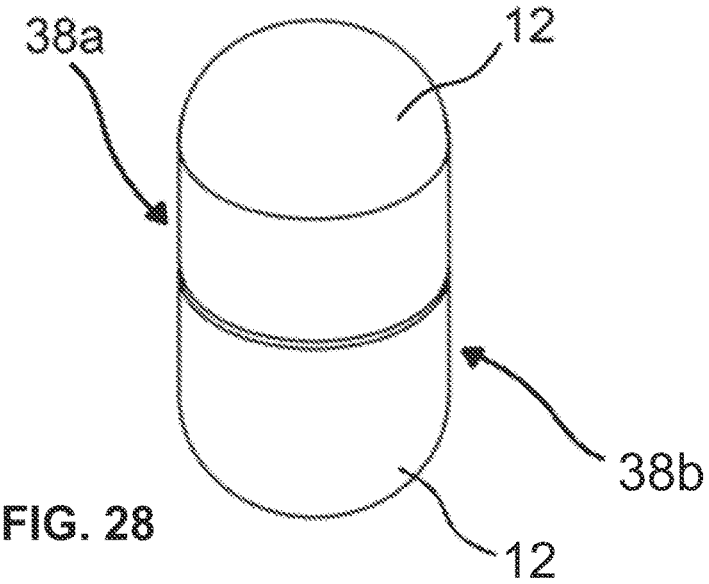

FIG. 26 shows an additional design shape of a capsule, or spherocylinder external complimentary capsule surface 12 and internal sealing capsule surfaces 14 having exterior section of oval, 38*a*. FIG. 27 has an additional design shape of a capsule, or spherocylinder. Internal sealing capsule surfaces, 14 of oval, 38*b*. The FIG. 28 additional design in in the shape of a capsule, or spherocylinder, external complimentary capsule surface, exterior section of oval 38*a* and 38*b*. In such embodiments of this invention the components may or may not be identical. Identical components permit fast assembly and re-throw. Non-identical components raise excitement in a different way by having to find parts that work together first.

A further embodiment may additionally include a "surprise toy" within the capsule adding functional use of packaging for additional surprise toys wherein a small toy such a toy car, ball, jacks games or other small objects may be sold/packaged as housed within the two capsule halves when sold together, additionally enabling the water capsule toy to be used for the function of packaging.

Figure 29:
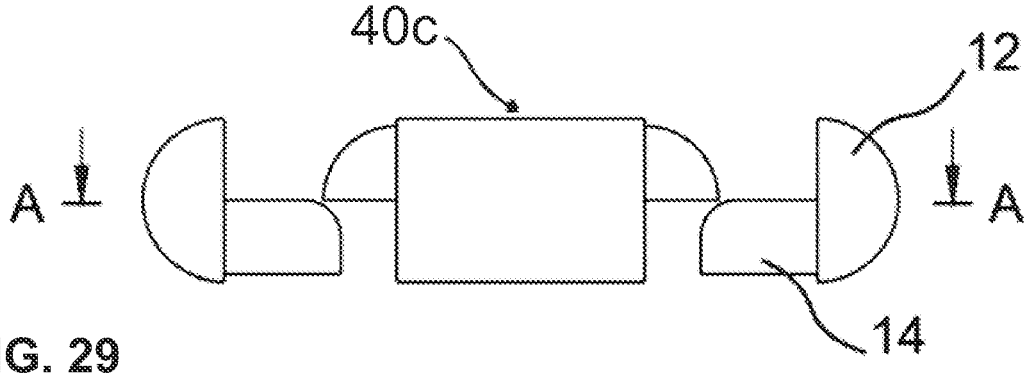
FIGS. 29, 30, 31 and 32 illustrate additional design shape of an elongated capsule, or sphero-cylinder, which design incorporates two identical end capsules that are placed on the middle interior cylinder. An assembled sphero-cylinder, capusule and the like in accordance with the invention.
Figure 30:
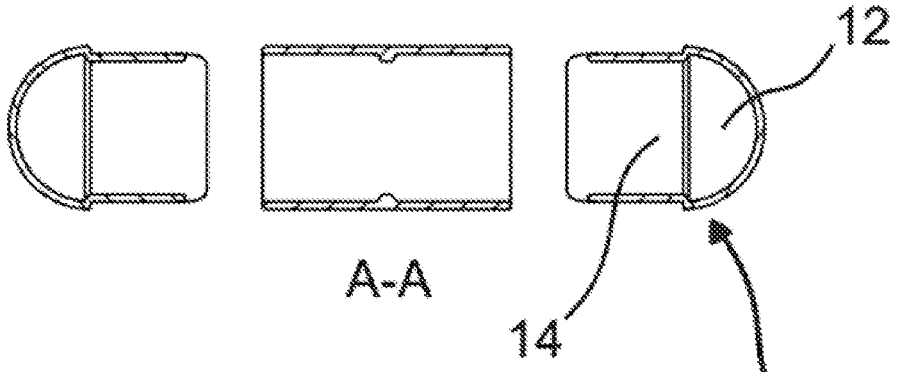
Figure 31:
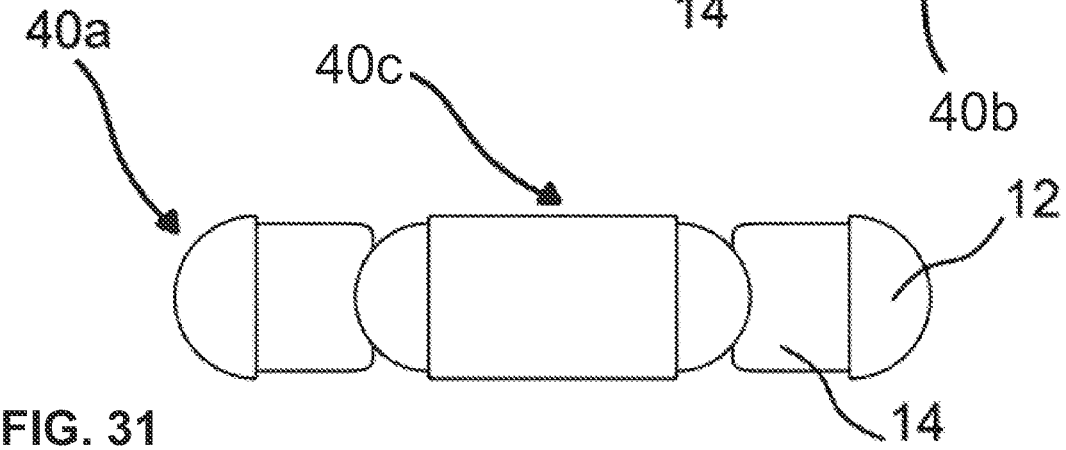
Figure 32:
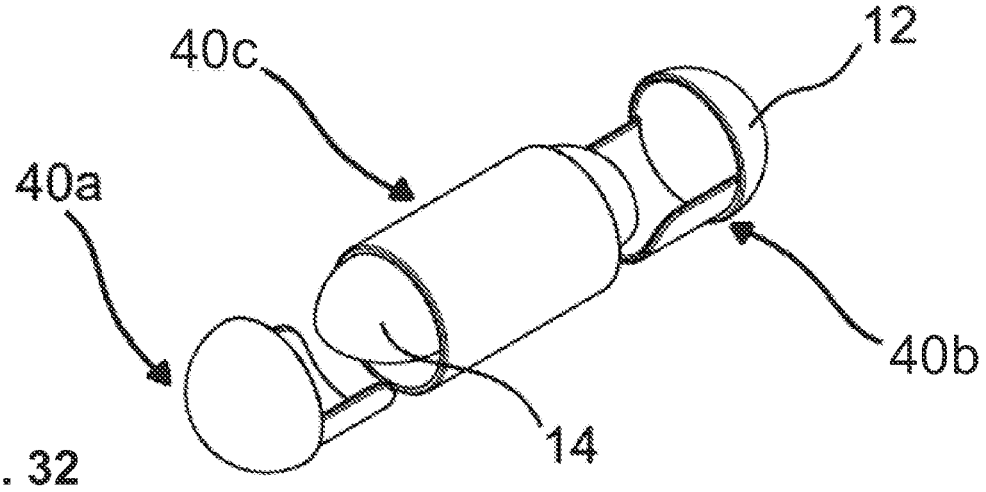

Turning to FIG. 29 an additional design shape provides an elongated capsule, or spherocylinder. This design has two identical end capsules that are placed on the middle interior cylinder. This design has more than two components and adds to the excitement of the game; also this design may extend the time to fill and could be limited to under water filling option. External complimentary capsule surface, 12. Internal sealing capsule surfaces, 14. Middle cylinder with two internal sealing surfaces 40*c*. FIG. 30 is in cross section of sealing edges of additional design shape of an elongated capsule, or spherocylinder. This design has two identical end capsules that are placed on the middle interior cylinder. External complimentary capsule surface 12 and internal sealing capsule surfaces 14, with end capsule 40*b* of FIGS. 29-31 provide additional design shape of an elongated capsule, or spherocylinder. This design has two identical end capsules that are placed on the middle interior cylinder. External complimentary capsule surface 12 and internal sealing capsule surfaces 14 with end capsule 40*a* with middle cylinder with two internal sealing surfaces 40*c* of FIG. 32 has additional design shape of an elongated capsule, or spherocylinder. This design has two identical end capsules that are assembled on the middle interior cylinder. External complimentary capsule surface, 12. Internal sealing capsule surfaces, 14. End capsule, 40*a*. End capsule, 40*b*. Middle cylinder with two internal sealing surfaces, 40*c*.

Figure 33:
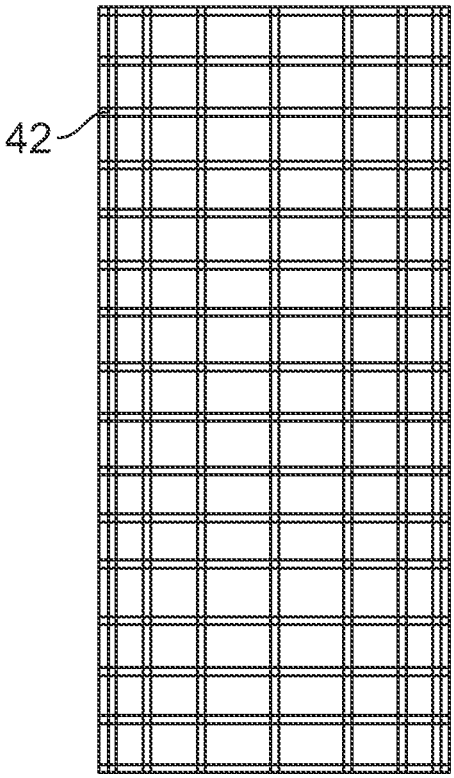
FIGS. 33 and 34 illustrate a submersible mesh bag and assembled capsules to be submerged in water to fill each capsule n accordance with the described embodiments.
Figure 34:
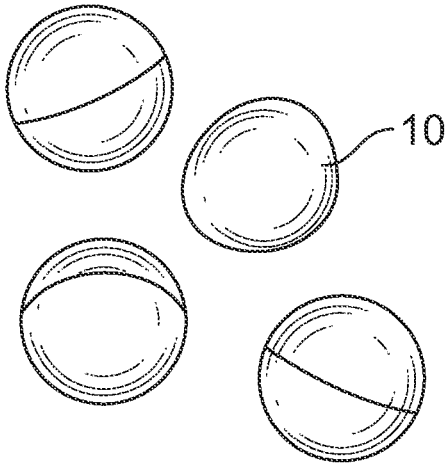
Figure 35:
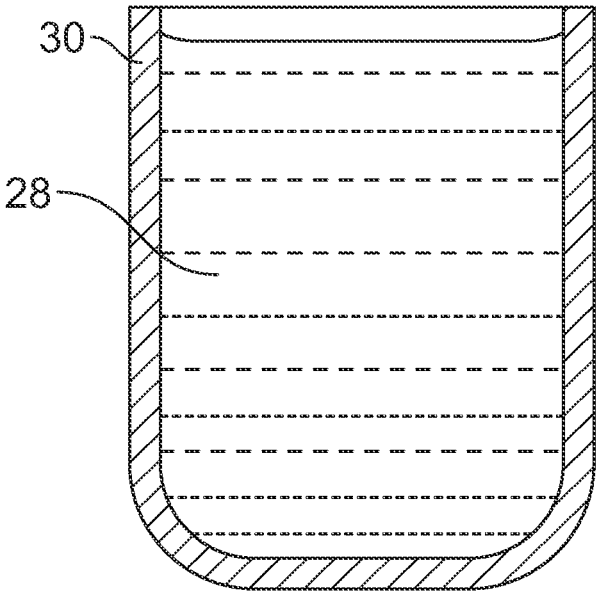
FIG. 35 shows a bucket full of fluid in cross-section for filling assembled capsules to be submerged in accordance with the described embodiments.
Figure 36:
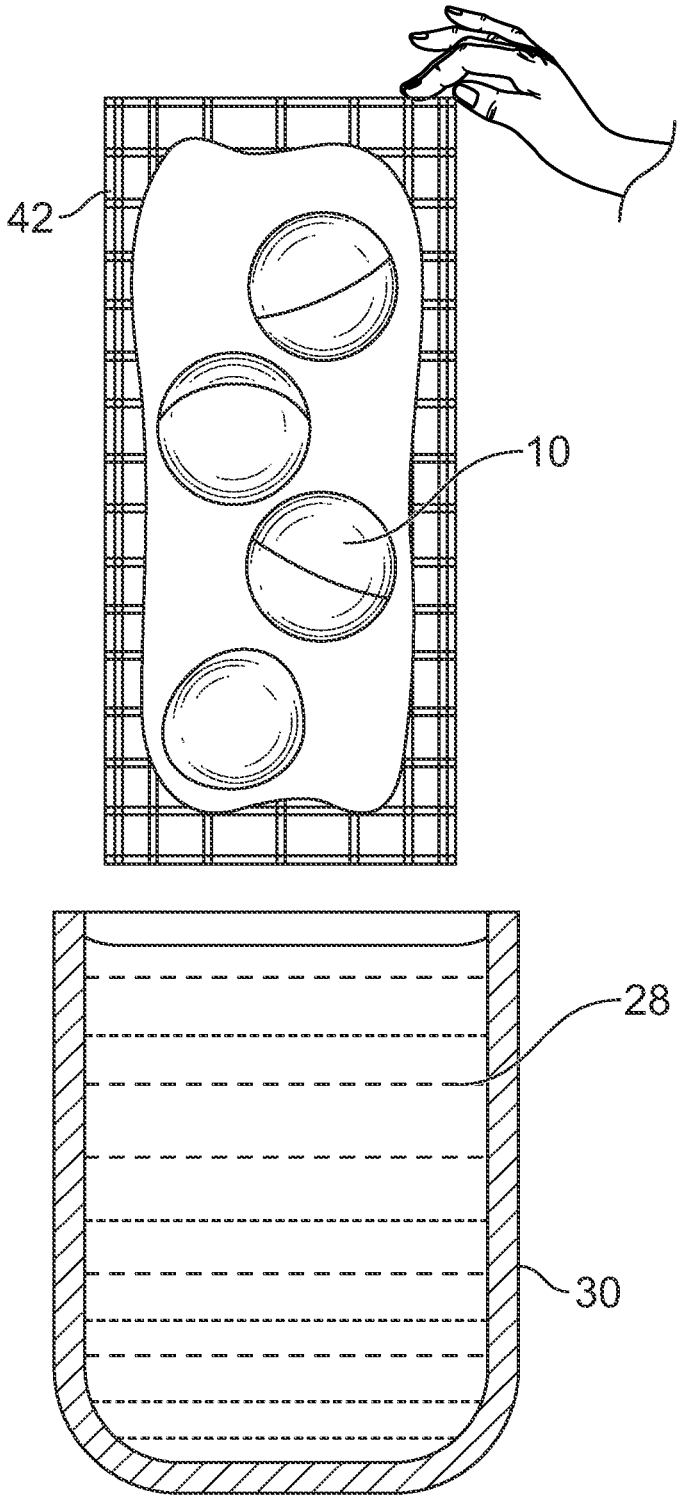
FIG. 36 illustrates a bucket full of fluid and a submersible mesh bag containing empty assembled capsules being lowered into bucket in accordance with the described embodiments.
Figure 37:
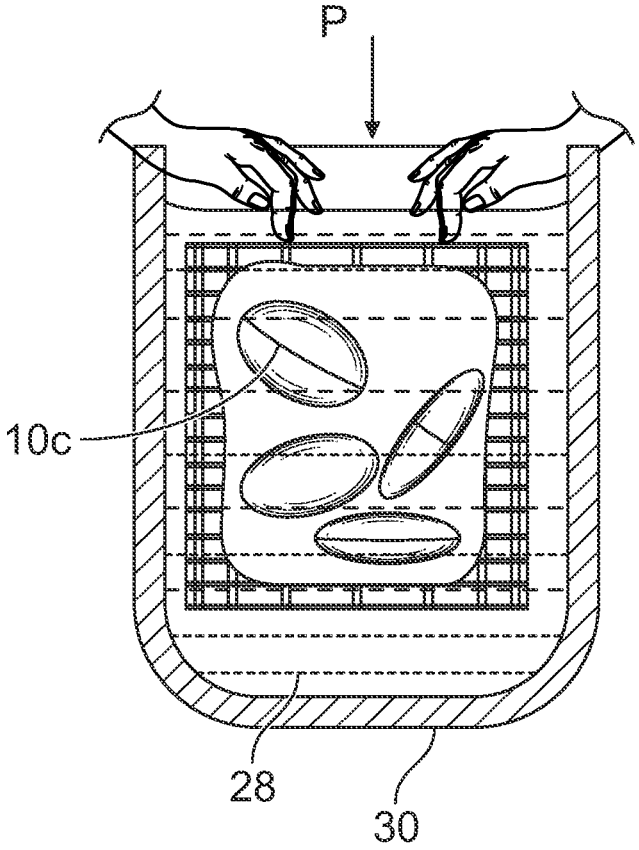
FIG. 37 illustrates the submersible mesh bag with assembled capsules in a bucket full of fluid and a submersible mesh bag showing capsules under compressive pressure expelling air for assembled capsules being submerged in water to fill each capsule in accordance with the described embodiments.

FIGS. 33 and 34 illustrate a submersible mesh bag and assembled capsules to be submerged in water to fill each capsule with in accordance with the described embodiments. Net bag 42 is submersed in water 28 for capsule 10 in a container such as a bucket 30 or the like. FIG. 36 illustrates the submersible mesh bag with assembled capsules bucket full of fluid submersible mesh bag containing empty assembled capsules being lowered into water 28. FIG. 37 illustrates the submersible mesh bag with assembled capsules in a bucket full of fluid and a submersible mesh bag showing capsules under compression pressure expelling air for assembled capsules being submerged in water to fill each capsule 10. Typically during play disassembled components will be placed together and players will find and assemble components and charge the capsules with water. One way that increases excitement in play is the following. The components are assembled in a net bag or similar or they are first placed then assembled in the bag FIG. 33. The net bag 42 is then submerged in water for example in a bucket. The hands are then be used to apply a pressure P FIGS. 33 and 34 by pressing down on the bag a number of times compressing the capsules each time. The bag can now be removed from the bucket and the capsules will have stayed assembled and be full with water. FIG. 35 shows a bucket full of fluid in cross-section for filling assembled capsules to be submerged in accordance with the described embodiments. FIG. 36 illustrates the submersible mesh or net bag 42 with assembled capsules 10 bucket full of fluid submersible mesh bag containing empty assembled capsules. FIG. 37 illustrates the submersible mesh bag with assembled capsules in a bucket full of fluid. The submersible mesh bag shows the assembled capsules under compressive pressure in order to fill each capsule with in accordance with the described embodiments.

The fillable water game toy structures may be provided in multiple forms and sizes, e.g., a 50-millimeter capsule size for capsule toy deployments and a larger 65-millimeter tennis ball size for the full balloon exploding experience and enjoy water balloons and capsule toys. There are a variety rubber types and methods, both vulcanizing and non-vulcanizing that may be employed to make this reusable water toy capsule 10. Advantageous identified materials were considered to include plastics and soft rubber-like materials such as polyvinyl chloride (PVC), thermoplastic rubber or elastomers (TPR or TPE) resins or other composites formed of any material, blends, mixtures, or combinations such that the soft projectile has a Shore A hardness value of about 20 to about 55, about 25 to about 50, about 30 to about 45, or about 35 to about 40. Ball examples tested include 2, 3, 4 mm ball thickness; other suitable values may include about 1, 2, 3, 4, 5, 6, 7, or 8 mm thicknesses. Batches of testing samples considered in different materials/thickness/hardness testing data on PVC, TPR and TPE, with "softness" of the materials include, e.g.: PVC/50 degree-1, 2, 3, 4 mm ball thickness; TPR/50 degree-1, 2, 3, 4 mm ball thickness; TPE/40 degree-1, 2, 3, 4 mm ball thicknesses. Material durometer hardness of 30, 40, 50 generally with materials, e.g. TPR/TPE 30, 40, 50, PVC 30, 40, 50 and the like with wall thicknesses of 1.25 mm, 1.5 mm, 1.75 mm, and 2.0 mm are also found to work. Examples identify a number of differing options are being considered as potential PVC, TPR or TPE materials. TPE: e.g. manufacturer Terinseo™ bio TPE introduction, the distributor Plastech HK™ resin samples. PVC: e.g. manufacturer Grandtec™ green PVC, using hardness Shore A 40 green PVC commercially available.

| Example 1 | | | | Example 2 | | | |
|---|---|---|---|---|---|---|---|
| Material: PVC 50°<br>Ball thickness: 2 mm<br>Testing criteria: free fall<br>2 halves of ball/parting line orientation: horizontal placement<br>Height; plastic part weight(g); total weight w/water (g) | | | | Material: TPR 50°<br>Ball thickness: 2 mm<br>Testing criteria: free fall<br>2 halves of ball/parting line orientation: vertical placement<br>Height; plastic part weight(g); total weight w/water (g) | | | |
| 1.0M | 52.5 | 122 | ok | 1.0M | 43.9 | 114.6 | ok |
| 1.5M | 52.5 | 122.5 | ok | 1.5M | 43.9 | 114.3 | ok |
| 1.8M | 52.5 | 122.3 | ok | 1.8M | 43.9 | 113.9 | ok |
| 2.0M | 52.5 | 122.5 | ok | 2.0M | 43.9 | 114.5 | ok |
| **Example 3** | | | | **Example 4** | | | |
| Material: TPE 40°<br>Ball thickness: 2 mm<br>Testing criteria: free fall<br>2 halves of ball/parting line orientation: vertical placement<br>Height; plastic part weight(g); total weight w/water (g) | | | | Material: TPE 40°<br>Ball thickness: 2 mm<br>Testing criteria: free fall<br>2 halves of ball/parting line orientation: horizontal placement<br>Height; plastic part weight(g); total weight w/water (g) | | | |
| 1.0M | 45.3 | 113.7 | ok | 1.0M | 45.3 | 113.7 | ok |
| 1.5M | 45.3 | 112.9 | ok | 1.5M | 45.3 | 112.9 | ok |
| 1.8M | 45.3 | 112.5 | ok | 1.8M | 45.3 | 112.5 | ok |
| 2.0M | 45.3 | 113.3 | ok | 2.0M | 45.3 | 113.3 | ok |

Balancing less material in the mold/sufficient break-apart on impact, specifics of the composition of the capsule including the specific range of materials that could be used, the range of possible wall thickness expected to be used and any alternative configurations. Prototyped 2 mm, 3 mm & 4 mm wall thicknesses and defined PVC and TPE as the materials, where 2 mm wall thickness proved in testing to be the best performing and useless material, has less weight and contributes to best performance. Such may be made from soft plastic materials that present none of the safety concerns of undue shore hardness by molding with "bio-TPE" of hardness shore A 35 and 40 in 2 mm thickness.

A variety of different reusable toy capsule apparatus have been disclosed including a pair of flexible components, each with a first wall having a first wall edge and a first wall external surface in the shape of a half sphere curved surface and a first wall internal surface thereof; a second wall having a second wall edge and a second wall external surface in the shape of a quarter sphere curved surface and a second wall internal surface thereof, said second wall integrally formed with said first wall together as a curved surface in the shape of a three-quarter sphere and defining an opening between the first wall edge and the second wall edge with a fluid-holding interior; and a fluid seal formed with said pair of flexible components where a portion of each second wall external surface is brought into apposition with a portion of each first wall internal surface of said pair of flexible components. The reusable toy capsule apparatus further wherein the portion of each second wall external surface comprises a coupling flange for being brought into apposition with the portion of the first wall internal surface. The reusable toy capsule apparatus wherein the first wall edge comprises a primary sealing edge, and the second wall edge comprises a secondary sealing edge.

The reusable toy capsule apparatus may further include at least one rib on the first wall internal surface where the a secondary sealing edge engages said at least one rib when portion of each second wall external surface is brought into apposition with a portion of each first wall internal surface of said pair of flexible components. The reusable toy capsule apparatus including a plurality of ribs on the first wall internal surface. The reusable toy capsule apparatus further having one or more ribs on the second wall internal surface.

Also a reusable toy capsule methods have been disclosed providing a pair of flexible components, each having a first wall with a first wall external surface and a first wall internal surface thereof, and having a second wall with a second wall external surface and a second wall internal surface thereof; disposing the second wall integrally together with the first wall; defining a fluid-holding interior; receiving fluid between the first wall and the second wall; and forming a fluid seal with the pair of flexible components where a portion of each second wall external surface is brought into apposition with a portion of each first wall internal surface of the pair of flexible components. The reusable toy capsule methods further wherein the step of receiving fluid into the fluid-holding interior between the pair of flexible components first and the second wall external surfaces brought into apposition further comprises providing a partial vacuum sufficient for a lower relative internal pressure inside the fluid-holding interior for creating a suction force that moves fluid into the fluid-holding interior within the pair of flexible components. The reusable toy capsule methods can provide a first wall edge at the first wall of each flexible component, and provide a second wall edge the second wall of each flexible component defining an opening into each flexible component between the first wall edge and the second wall edge. The reusable toy capsule methods can provide a primary sealing edge along the first wall edge, with the portion of each second wall external surface brought into apposition with the portion of the first wall internal surface with the second wall edge providing a secondary sealing edge, and maintaining fluid in the fluid-holding interior with hydrostatic pressure of the fluid pushing against the walls to generate surface tension at the fluid-holding interior within the pair of flexible components.

From the foregoing, it can be seen that there has been provided a unique mechanical toy apparatus operated as an amusement device in the general form of a reusable exploding water toy capsule in a way that is simple yet unique and exciting for a user. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A reusable toy capsule apparatus, comprising:

a pair of flexible components, each flexible component comprising:

a first wall having a first wall external surface and a first wall internal surface thereof;

a second wall having a second wall external surface and a second wall internal surface thereof, said second wall integrally formed together with said first wall defining a fluid-holding interior for receiving fluid between said first wall and said second wall, wherein the first wall external surface comprises a curved surface in the shape of a half sphere, and wherein the second wall external surface comprises a curved surface in the shape of a quarter sphere with said second wall integrally formed with said first wall together as a curved surface in the shape of a three-quarter sphere; and a fluid seal formed with said pair of flexible components where a portion of each second wall external surface is brought into apposition with a portion of each first wall internal surface of said pair of flexible components.

2. The reusable toy capsule apparatus recited in claim 1, wherein said first wall of each flexible component further comprises a first wall edge, and said second wall of each flexible component further comprises a second wall edge defining an opening into each flexible component between the first wall edge and the second wall edge.

3. The reusable toy capsule apparatus recited in claim 2, wherein the first wall edge comprises a primary sealing edge, and the second wall edge comprises a secondary sealing edge.

4. The reusable toy capsule apparatus recited in claim 3, further comprising at least one rib on the first wall internal surface where the secondary sealing edge engages said at least one rib when a portion of each second wall external surface is brought into apposition with a portion of each first wall internal surface of said pair of flexible components.

5. The reusable toy capsule apparatus recited in claim 3, further comprising a plurality of ribs on the first wall internal surface.

6. The reusable toy capsule apparatus recited in claim 3, further comprising one or more ribs on the second wall internal surface.

7. The reusable toy capsule apparatus recited in claim 1, further comprising one or more further flexible components having a curved wall internal surface and a curved wall external surface forming another fluid seal with said pair of flexible components where a portion of the second wall external surface is brought into apposition with a portion of the curved wall internal surface of the one or more further flexible components.

8. A reusable toy capsule apparatus, comprising:

a pair of flexible components, each flexible component comprising:

a first wall having a first wall edge and a first wall external surface in the shape of a half sphere curved surface and a first wall internal surface thereof;

a second wall having a second wall edge and a second wall external surface in the shape of a quarter sphere curved surface and a second wall internal surface thereof, said second wall integrally formed with said first wall together as a curved surface in the shape of a three-quarter sphere and defining an opening between the first wall edge and the second wall edge with a fluid-holding interior; and a fluid seal formed with said pair of flexible components where a portion of each second wall external surface is brought into apposition with a portion of each first wall internal surface of said pair of flexible components.

9. The reusable toy capsule apparatus recited in claim 8, wherein the first wall edge comprises a primary sealing edge, and the second wall edge comprises a secondary sealing edge.

10. The reusable toy capsule apparatus recited in claim 9, further comprising at least one rib on the first wall internal surface where the a secondary sealing edge engages said at least one rib when portion of each second wall external surface is brought into apposition with a portion of each first wall internal surface of said pair of flexible components.

11. The reusable toy capsule apparatus recited in claim 9, further comprising a plurality of ribs on the first wall internal surface.

12. The reusable toy capsule apparatus recited in claim 9, further comprising one or more ribs on the second wall internal surface.

13. A reusable toy capsule method, comprising:

providing a pair of flexible components, each having a first wall with a first wall external surface and a first wall internal surface thereof, and having a second wall with a second wall external surface and a second wall internal surface thereof, wherein the first wall external surface comprises a curved surface in the shape of a half sphere, and wherein the second wall external surface comprises a curved surface in the shape of a quarter sphere with said second wall integrally formed with said first wall together as a curved surface in the shape of a three-quarter sphere;

defining a fluid-holding interior;

receiving fluid between the first wall and the second wall; and forming a fluid seal with the pair of flexible components where a portion of each second wall external surface is brought into apposition with a portion of each first wall internal surface of the pair of flexible components.

14. The reusable toy capsule method recited in claim 13, wherein the step of receiving fluid into the fluid-holding interior between the pair of flexible components first and the second wall external surfaces brought into apposition further comprises providing a partial vacuum sufficient for a lower relative internal pressure inside the fluid-holding interior for creating a suction force that moves fluid into the fluid-holding interior within the pair of flexible components.

15. The reusable toy capsule method recited in claim 13, comprising the steps of providing a first wall edge at the first wall of each flexible component, and providing a second wall edge the second wall of each flexible component defining an opening into each flexible component between the first wall edge and the second wall edge.

16. The reusable toy capsule method recited in claim 14, comprising the steps of providing a primary sealing edge along the first wall edge, with the portion of each second wall external surface brought into apposition with the portion of the first wall internal surface with the second wall edge providing a secondary sealing edge, and maintaining fluid in the fluid-holding interior with hydrostatic pressure of the fluid pushing against the walls to generate surface tension at the fluid-holding interior within the pair of flexible components.

* * * * *